US011199079B2

(12) United States Patent
Tiwari

(10) Patent No.: US 11,199,079 B2
(45) Date of Patent: Dec. 14, 2021

(54) DOWNHOLE HYDROGEN SULFIDE NEUTRALIZER

(71) Applicant: Saudi Arabian Oil Company, Dhahran (SA)

(72) Inventor: Shrikant Tiwari, Dhahran (SA)

(73) Assignee: SAUDI ARABIAN OIL COMPANY

( * ) Notice: Subject to any disclaimer, the term of this patent is extended or adjusted under 35 U.S.C. 154(b) by 105 days.

(21) Appl. No.: 16/807,794

(22) Filed: Mar. 3, 2020

(65) Prior Publication Data

US 2021/0277761 A1 Sep. 9, 2021

(51) Int. Cl.

| | |
|---|---|
| ***E21B 43/38*** | (2006.01) |
| ***E21B 34/08*** | (2006.01) |
| ***E21B 27/00*** | (2006.01) |

(52) U.S. Cl.

CPC ..... *E21B 43/38* (2013.01); *E21B 27/00* (2013.01); *E21B 34/08* (2013.01); *E21B 2200/05* (2020.05)

(58) Field of Classification Search

CPC ..... E21B 43/38; E21B 34/08; E21B 27/00; E21B 2200/05

See application file for complete search history.

(56) References Cited

U.S. PATENT DOCUMENTS

| | | | | |
|---|---|---|---|---|
| 3,928,211 | A | 12/1975 | Browning et al. | |
| 4,157,732 | A | 6/1979 | Fonner | |
| 4,483,397 | A | 11/1984 | Gray | |
| 5,095,977 | A * | 3/1992 | Ford | E21B 41/02 166/113 |
| 5,310,000 | A | 5/1994 | Arterbury et al. | |
| 5,355,956 | A | 10/1994 | Restarick | |
| 6,365,053 | B1 * | 4/2002 | Sunde | C09K 8/035 210/747.1 |
| 7,195,070 | B2 | 3/2007 | Delaloye et al. | |

(Continued)

FOREIGN PATENT DOCUMENTS

| | | | |
|---|---|---|---|
| RU | 2318863 | C2 | 3/2008 |
| WO | 2009129445 | A2 | 10/2009 |

(Continued)

OTHER PUBLICATIONS

International Search Report and Written Opinion for PCT Application No. PCT/US2021/020571 dated Mar. 3, 2021.

*Primary Examiner* — Blake E Michener
(74) *Attorney, Agent, or Firm* — Bracewell LLP; Constance Gall Rhebergen; Linda L. Morgan

(57) ABSTRACT

Systems and methods for neutralizing a hydrogen sulfide within a subterranean well include a hydrogen sulfide neutralizing tool having a tubular member. A tool shell circumscribes the tubular member, defining tool annular space between an outer diameter surface of the tubular member and an inner diameter surface of the tool shell. A sacrificial rod is located within the tool annular space and is formed of a material that produces metal sulfide when exposed to the hydrogen sulfide. An uphole perforation has an opening extending through a sidewall of the tubular member, defining a fluid flow path between the tool annular space and the internal bore of the tubular member. A downhole perforation is located downhole of the uphole perforation and hays an opening extending through the sidewall of the tubular member, defining a fluid flow path between the tool annular space and the internal bore of the tubular member.

16 Claims, 3 Drawing Sheets

(56) References Cited

U.S. PATENT DOCUMENTS

| | | | | |
|---|---|---|---|---|
| 10,279,421 | B2 | 5/2019 | Ringgenberg | |
| 2002/0189445 | A1* | 12/2002 | Miller | B01D 69/02 95/51 |
| 2006/0243642 | A1* | 11/2006 | Thompson | B01J 20/3458 208/208 R |
| 2009/0100753 | A1* | 4/2009 | Schulz | C10L 3/102 48/127.5 |
| 2012/0220500 | A1* | 8/2012 | Matza | E21B 43/38 507/103 |
| 2016/0115370 | A1 | 4/2016 | McCubbins, Jr. et al. | |
| 2016/0215617 | A1* | 7/2016 | Samec | E21B 49/088 |
| 2018/0201825 | A1 | 7/2018 | Raghuraman et al. | |
| 2020/0392843 | A1* | 12/2020 | Golovko | G01N 33/0044 |

FOREIGN PATENT DOCUMENTS

| | | | |
|---|---|---|---|
| WO | 2015050551 | A1 | 4/2016 |
| WO | 2018063140 | A1 | 4/2018 |

* cited by examiner

DOWNHOLE HYDROGEN SULFIDE NEUTRALIZER

BACKGROUND

1. Field of the Disclosure

The present disclosure relates in general to the development of subterranean wells, and more particularly to reducing levels of hydrogen sulfide of a produced fluid within the subterranean well.

2. Description of the Related Art

When developing hydrocarbons from subterranean wells, hydrogen sulfide (H2S) can be encountered. Some hydrocarbon wells can contain a relatively high concentration of hydrogen sulfide, which is also known as acid gas or sour gas. Hydrogen sulfide can be toxic and corrosive and requires that safety precautions be undertaken if the hydrogen sulfide reaches the surface. An elevated amount of hydrogen sulfide poses a risk to operating personnel and the population in nearby areas. Any release of hydrogen sulfide in the atmosphere can cause environmental damage and injury to other people or animals.

Hydrogen sulfide can also increase the risk of surface equipment failure. Hydrogen sulfide can cause sulfide stress cracking. Hardened steel is more susceptible to sulfide stress cracking at lower temperatures. High strength carbon steel becomes brittle when exposed to sulfide stress cracking and develops cracks, which can lead to failure of the components formed of such steel. Surface equipment on a drilling rig or production facilities can require the use special hydrogen sulfide resistant steel and rubber elements to avoid catastrophic failure or the release of poisonous gas in and around working area.

In exploratory wells the exact concentration of hydrogen sulfide may not be known until surface measurements are carried out. Exploratory wells are drilled in an undeveloped area for discovering new reservoirs and collecting subsurface geological data. After an exploratory well is drilled to the planned target depth, the well is tested. Well testing can be carried out for evaluating the reservoir potential. In some current developments, conclusive measurements for making appropriate reservoir evaluation can be made only if formation fluid is flowed to surface.

SUMMARY OF THE DISCLOSURE

The existence of amounts of hydrogen sulfide in the reservoir fluid can restrict the ability of an operator to safely flow a well to the surface and to carry out a proper evaluation of reservoir potentials. It can be risky to perform drill stem tests on wells with elevated amounts of hydrogen sulfide and as a result, some drill stem tests are aborted before being completed if higher concentrations of hydrogen sulfide are detected during the test.

Embodiments of this disclosure can neutralize a part or all of the hydrogen sulfide downhole during flowback. By reducing the concentration of hydrogen sulfide being produced to the surface the flow testing on the well can be completed.

In an embodiment of this disclosure, a hydrogen sulfide neutralizing tool for neutralizing hydrogen sulfide within a subterranean well includes a tubular member with an internal bore. A tool shell circumscribes the tubular member and defines a tool annular space between an outer diameter surface of the tubular member and an inner diameter surface of the tool shell. Sacrificial rods are located within the tool annular space, the sacrificial rod formed of a material that produces metal sulfide when exposed to the hydrogen sulfide. The tubular member includes an uphole perforation. The uphole perforation has an opening extending through a sidewall of the tubular member defining a fluid flow path between the tool annular space and the internal bore of the tubular member. The tubular member includes a downhole perforation. The downhole perforation is located downhole of the uphole perforation and has an opening extending through the sidewall of the tubular member defining a fluid flow path between the tool annular space and the internal bore of the tubular member.

In alternate embodiments, the hydrogen sulfide neutralizing tool can further include a non-return valve. The non-return valve can be operable to allow a fluid flow through the non-return valve in a downhole direction and block the fluid flow through the non-return valve in an uphole direction. A rod structural support can be located within the tool annular space and can extend between the sacrificial rod to at least one of the tubular member and the tool shell. A junk basket can be located within the tool annular space downhole of the sacrificial rod.

In an alternate embodiment of this disclosure, a system for neutralizing hydrogen sulfide within a subterranean well with a hydrogen sulfide neutralizing tool includes a drill stem testing string extending within a wellbore of the subterranean well. The drill stem testing string has a central bore and defines a wellbore annular space between an outer diameter of the drill stem testing string and an inner diameter surface of the wellbore. The drill stem testing string further includes the hydrogen sulfide neutralizing tool secured in-line. The hydrogen sulfide neutralizing tool has a tubular member with an internal bore in fluid communication with the central bore extending through adjacent members of the drill stem testing string. A tool shell circumscribes the tubular member and defines a tool annular space between an outer diameter surface of the tubular member and an inner diameter surface of the tool shell. A sacrificial rod is located within the tool annular space. The sacrificial rod is formed of a material that produces metal sulfide when exposed to the hydrogen sulfide. The tubular member includes an uphole perforation. The uphole perforation has an opening extending through a sidewall of the tubular member defining a fluid flow path between the tool annular space and the internal bore of the tubular member. The tubular member includes a downhole perforation. The downhole perforation is located downhole of the uphole perforation and has an opening extending through the sidewall of the tubular member defining a fluid flow path between the tool annular space and the internal bore of the tubular member.

In alternate embodiments, the system can further include a non-return valve operable to allow a fluid flow through the drill stem testing string past the non-return valve in a downhole direction, and to block the fluid flow through the drill stem testing string past the non-return valve in an uphole direction. A plurality of the sacrificial rods can be spaced around a circumference of the tool annular space. A rod structural support can include a ring shaped member extending between each of the plurality of the sacrificial rods. A junk basket can be located within the tool annular space downhole of the sacrificial rod. The junk basket can be positioned to collect the produced metal sulfide within the drill stem testing string.

In another alternate embodiment of this disclosure, a method for neutralizing a hydrogen sulfide within a subterranean well with a hydrogen sulfide neutralizing tool includes providing the hydrogen sulfide neutralizing tool having a tubular member with an internal bore. A tool shell circumscribes the tubular member and defines a tool annular space between an outer diameter surface of the tubular member and an inner diameter surface of the tool shell. A sacrificial rod is located within the tool annular space, the sacrificial rod formed of a material that produces metal sulfide when exposed to the hydrogen sulfide. The tubular member includes an uphole perforation. The uphole perforation has an opening extending through a sidewall of the tubular member, defining a fluid flow path between the tool annular space and the internal bore of the tubular member. The tubular member includes a downhole perforation. The downhole perforation is located downhole of the uphole perforation and has an opening extending through the sidewall of the tubular member defining a fluid flow path between the tool annular space and the internal bore of the tubular member. The method further includes forming a drill stem testing string having the hydrogen sulfide neutralizing tool secured in-line. The drill stem testing string is extended within a wellbore of the subterranean well. The drill stem testing string has a central bore and defines a wellbore annular space between an outer diameter of the drill stem testing string and an inner diameter surface of the wellbore. Upward flow of fluids is directed through the hydrogen sulfide neutralizing tool to contact the sacrificial rod, consuming the hydrogen sulfide from the flow of fluids by producing the metal sulfide from the sacrificial rod.

In alternate embodiments, the hydrogen sulfide neutralizing tool can further include a non-return valve. The non-return valve can allow a fluid flow through the non-return valve in a downhole direction and can block the fluid flow through the non-return valve in an uphole direction. A flow of fluid traveling in an uphole direction can be directed from the internal bore of the tubular member, through the downhole perforation, and into the tool annular space. The flow of fluid can be further directed past the sacrificial rod, and from the tool annular space, through the uphole perforation, and into the internal bore of the tubular member.

In other alternate embodiments, the sacrificial rod can be supported with a rod structural support. The rod structural support can be located within the tool annular space and extend between the sacrificial rod to at least one of the tubular member and the tool shell. The hydrogen sulfide neutralizing tool can further include a plurality of the sacrificial rods. The plurality of the sacrificial rods can be spaced around a circumference of the tool annular space. The sacrificial rod can be supported with a rod structural support. The rod structural support can include a ring shaped member extending between each of the plurality of the sacrificial rods. The metal sulfide can be collected in a junk basket located within the tool annular space downhole of the sacrificial rod.

BRIEF DESCRIPTION OF THE DRAWINGS

So that the manner in which the above-recited features, aspects and advantages of the disclosure, as well as others that will become apparent, are attained and can be understood in detail, a more particular description of the embodiments of the disclosure briefly summarized above may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The Specification, which includes the Summary of Disclosure, Brief Description of the Drawings and the Detailed Description, and the appended Claims refer to particular features (including process or method steps) of the disclosure. Those of skill in the art understand that the disclosure includes all possible combinations and uses of particular features described in the Specification. Those of skill in the art understand that the disclosure is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this disclosure relates unless defined otherwise.

As used in the Specification and appended Claims, the singular forms "a", "an", and "the" include plural references unless the context clearly indicates otherwise. As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Spatial terms describe the relative position of an object or a group of objects relative to another object or group of objects. The spatial relationships apply along vertical and horizontal axes. Orientation and relational words including "uphole" and "downhole"; "above" and "below" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the Specification and appended Claims to a method comprising two or more defined steps, the defined steps can be carried out in any order or simultaneously except where the context excludes that possibility.

Figure 1:
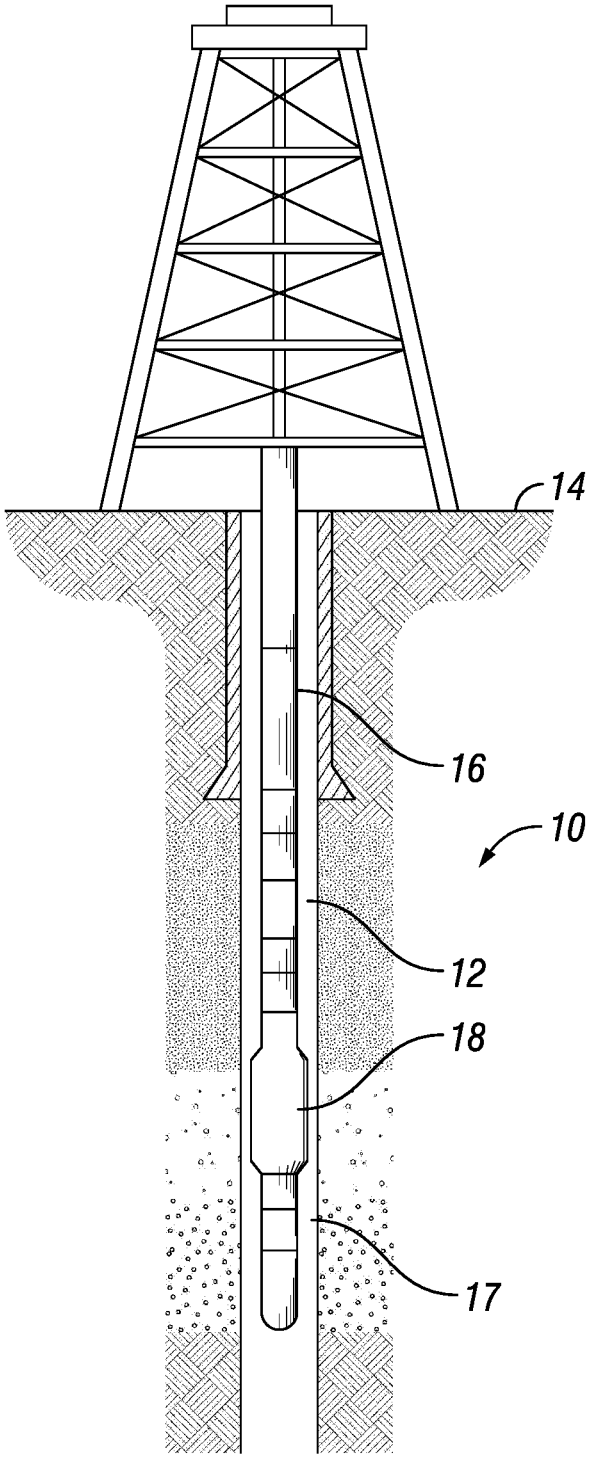
FIG. 1 is a schematic elevational section view of a drill stem testing string located within a subterranean well and having a hydrogen sulfide neutralizer, in accordance with an embodiment of this disclosure.

Looking at FIG. 1, subterranean well 10 can have wellbore 12 that extends to an earth's surface 14. Subterranean well 10 can be an offshore well or a land based well and can be used for evaluation or producing hydrocarbons from subterranean hydrocarbon reservoirs. Wellbore 12 can be drilled from surface 14 and into and through various subterranean formations.

During a drill stem test, drill stem testing string 16 can extend into wellbore 12. Drill stem testing string 16 can be a temporary completion of subterranean well 10 that is used to perform the drill stem test and then is removed from wellbore 12. During a drill stem test a selected reservoir can be isolated from the other portions of the wellbore. Drill stem testing string 16 can include a circulating sub, cross over sub, bypass, seal, packer, perforated sub, sensors, gauges, and multiple combinations of each such tools and equipment.

Drill stem testing string 16 has a central bore and defines a wellbore annular space between an outer diameter of drill stem testing string 16 and an inner diameter surface of wellbore 12. During a drill stem test, fluids are circulated in a direction downhole within drill stem testing string 16 and in a direction uphole within wellbore annular space 17. During a drill stem test, the direction of the flow of fluids is alternated one or more times and the fluids are alternately circulated in a direction uphole within drill stem testing string 16 and in a direction downhole within wellbore annular space 17. Characteristics of a particular reservoir, such as productive capacity, pressure, and permeability, can be calculated based on the data gathered during a drill stem test.

Hydrogen sulfide neutralizing tool 18 can be part of drill stem testing string 16, secured in-line with adjacent components of drill stem testing string 16. Hydrogen sulfide neutralizing tool 18 can be used for neutralizing hydrogen sulfide within subterranean well 10.

Figure 2:
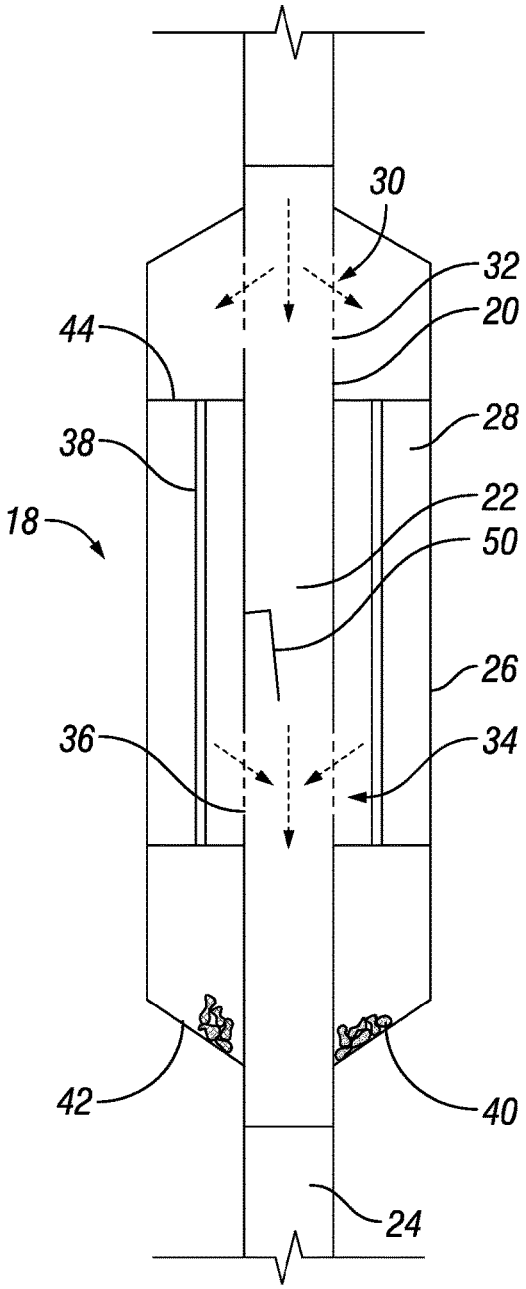
FIG. 2 is a schematic elevational section view of a hydrogen sulfide neutralizer, in accordance with an embodiment of this disclosure, shown with fluids flowing through the hydrogen sulfide neutralizerin a downhole direction.
Figure 3:
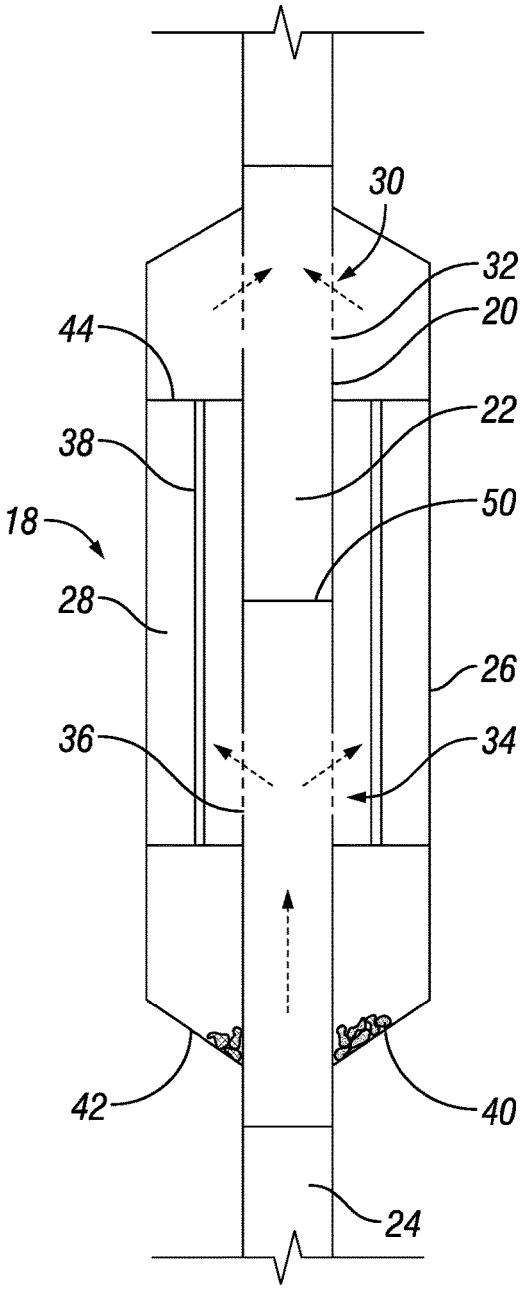
FIG. 3 is a schematic elevational section view of a hydrogen sulfide neutralizer, in accordance with an embodiment of this disclosure, shown with fluids flowing through the hydrogen sulfide neutralizerin an uphole direction.

Looking at FIGS. 2-3, hydrogen sulfide neutralizing tool 18 includes tubular member 20. Tubular member 20 has internal bore 22. Internal bore 22 is in fluid communication with central bore 24 extending through adjacent members of drill stem testing string 16. Internal bore 22 can be used for pumping fluids in a direction downhole and flowing formation fluid out of subterranean well 10. Tubular member 20 can have uphole and downhole connectors, such as threads, so that hydrogen sulfide neutralizing tool 18 can be made up with the adjacent members of drill stem testing string 16 and run into subterranean well 10 as part of drill stem testing string 16.

Figure 4:
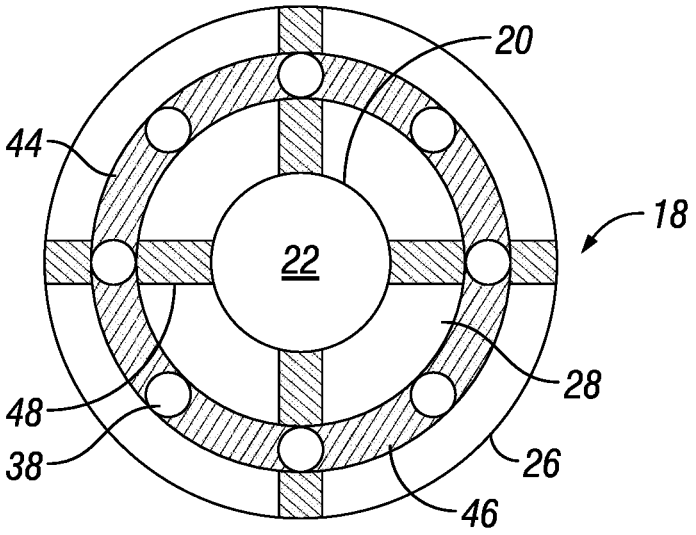
FIG. 4 is a schematic cross sectional view of a hydrogen sulfide neutralizer, in accordance with an embodiment of this disclosure.

Hydrogen sulfide neutralizing tool 18 further includes tool shell 26. Tool shell 26 circumscribes tubular member 20 and defines tool annular space 28 between an outer diameter surface of tubular member 20 and an inner diameter surface of tool shell 26. Tool shell 26 can have a circular cross section (FIG. 4). Tool shell 26 can have an uphole end and a downhole end that is secured to tubular member 20 so that tool annular space 28 has a sealed uphole end and a sealed downhole end. In the example embodiments of FIGS. 2-3, tool shell 26 has a cylindrical middle portion with frustoconical shaped uphole end and downhole end portions.

Tubular member 20 includes uphole perforation 30. Uphole perforation 30 has at least one opening 32 extending through a sidewall of tubular member 20. Uphole perforation 30 defines a fluid flow path between tool annular space 28 and internal bore 22 of tubular member 20. Tubular member 20 further includes downhole perforation 34. Downhole perforation 34 is located downhole of uphole perforation 30. Downhole perforation 34 has at least one opening 36 extending through a sidewall of tubular member 20. Downhole perforation 34 defines a fluid flow path between tool annular space 28 and internal bore 22 of tubular member 20.

Figure 5:
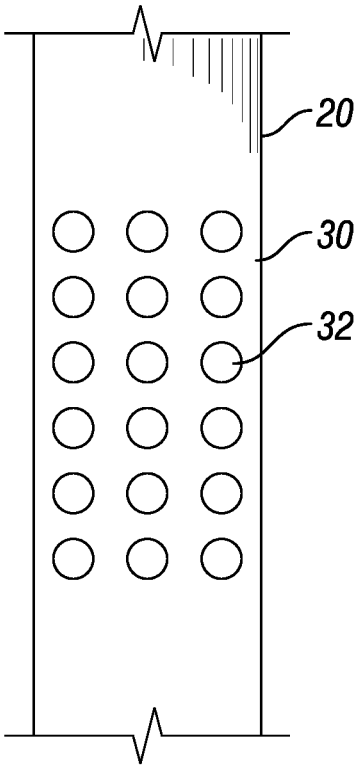
FIG. 5 is a schematic elevational detail view of a perforated portion of a hydrogen sulfide neutralizer, in accordance with an embodiment of this disclosure.

Looking at FIG. 5, uphole perforation 30 can include a plurality of openings 32. The sum of the area of all of the openings 32 can be at least as large as the cross sectional area of internal bore 22 of tubular member 20. This will ensure that there is no back pressure when the fluid flow passes only through openings 32 of uphole perforation 30, bypassing internal bore 22 (FIG. 3). Downhole perforation 34 can have the same configuration of as uphole perforation 30.

Looking at FIGS. 2-3, sacrificial rod 38 is located within tool annular space 28. Sacrificial rod 38 is formed of a material that produces metal sulfide when exposed to the hydrogen sulfide within the flow of fluids that passes by sacrificial rod 38. Sacrificial rod 38 is made of metal materials which have high affinity and are highly susceptible to reaction with hydrogen sulfide, relative to, for example, more ductile metal materials. Sacrificial rod 38 can be formed, for example, of high-strength steels, titanium alloys, or aluminum alloys.

As the hydrogen sulfide comes in contact with sacrificial rod 38, sacrificial rod 38 becomes brittle and corrodes, producing metal sulfide. During such process, hydrogen sulfide is consumed, which reduces the concentration of hydrogen sulfide in the formation fluid that is traveling to the surface. When the hydrogen sulfide reacts with the metal outer surface of sacrificial rod 38, the outer surface will crack and portions of the outer surface will peel and fall from sacrificial rod 38 as debris 40. Debris 40 can include the metal sulfides that are formed as a result of the reaction of the hydrogen sulfide with the metal of sacrificial rod 38. This cracking and peeling process will expose a fresh outer surface of sacrificial rod 38 that can be reacted with hydrogen sulfide, until all of the metal material of sacrificial rod 38 has been consumed and turned into debris 40.

Debris 40 can fall in a downhole direction and be trapped within junk basket 42. Junk basket 42 is located within tool annular space 28 downhole of sacrificial rod 38. Junk basket 42 can be defined between the outer diameter surface of tubular member 20 and the inner diameter surface of tool shell 26 and can be positioned to collect debris 40, which can include the produced metal sulfide, within drill stem testing string 16. Debris 40 can be removed from junk basket 42 when drill stem testing string 16 is returned to the surface after the well flow tests and other drill stem tests have been completed.

Looking at FIG. 4, a plurality of sacrificial rods 38 can be spaced around a circumference of tool annular space 28. The number, size, and spacing of sacrificial rods 38 can be selected so that there is sufficient volume of sacrificial rods 38 to neutralize hydrogen sulfide for the duration of the well testing. That is, not all of the sacrificial rods 38 will be consumed during the drill stem tests and some amount of sacrificial rods 38 will remain intact after the well flow tests and other drill stem tests have been completed. In this way, sacrificial rods 38 will not need to be replaced during the well test operations. In order to provide sufficient volume of sacrificial rods 38 to neutralize hydrogen sulfide for the duration of the well testing, more than one hydrogen sulfide neutralizing tool 18 can be part of drill stem testing string 16.

Looking at FIGS. 2-3, a flow of fluid can travel past sacrificial rod 38 by passing from internal bore 22 of tubular member 20, through uphole perforation 30 or downhole perforation 34, to travel within tool annular space 28. Rod structural support 44 can support sacrificial rod 38 within tool annular space 28. Rod structural support 44 can be located within tool annular space 28 and extend between sacrificial rod 38 and at least one of the tubular member 20 and tool shell 26.

Looking at FIG. 4, in an example embodiment, structural support 44 can include ring member 46 that extends between each of the plurality of sacrificial rods 38. A ring member 46 can be located at each end of the plurality of sacrificial rods 38. Structural support 44 can further include braces 48 that extend between tubular member 20 and tool shell 26 and can support ring member 46. Structural supports 44 can fix the uphole and downhole ring members within tool annular space 28, maintaining sacrificial rods 38 static within tool annular space 28. Because sacrificial rods 38 are solid members, and not a fluid or loose matter, sacrificial rods 38 can withstand the downhole pressure required for performing the drill stem testing, remaining in position within drill stem testing string 16 during such testing. As an example, reservoir pressures up to 10,000 psi are commonly encountered in oil and gas wells. Some fields and reservoirs may contain pressures of more than 10,000 psi.

Each of the tubular member 20, tool shell 26 and structural support 44 can be formed of a material that is resistant to hydrogen sulfide. Hydrogen embrittlement does not affect all metallic materials equally. High-strength steels, titanium alloys and aluminum alloys are more vulnerable to hydrogen sulfide than lower-strength steels. As an example, commonly used steel of grades J-55, K-55, L-80 have higher level of hydrogen sulfide resistance compared to higher strength grades, such as P-110 and Q-125

Looking at FIGS. 2-3, non-return valve 50 can be located within internal bore 22 of tubular member 20. Non-return valve 50 can be located within tubular member 20 axially between uphole perforation 30 and downhole perforation 34. Non-return valve 50 is shown in the example embodiments as a schematic flapper valve. In alternate embodiments, non-return valve 50 can instead be spring loaded, ball operated, radio-frequency identification activated, or can be another type of one way valve known in the industry.

Looking at FIG. 2, with non-return valve 50 in an open position fluids can flow through non-return valve in a downhole direction. When fluids are being pumped into subterranean well 10 through central bore 24 of drill stem testing string 16 from the surface, such fluid can pass through internal bore 22 of tubular member 20 and flow through and past non-return valve 50.

As can be seen in FIG. 2, a portion of the fluid flow that is pumped downhole through central bore 24 of drill stem testing string 16 from the surface will remain within internal bore 22 of tubular member 20 and will travel through non-return valve 50, with non-return valve 50 in the open position. Another portion of the fluid flowing through internal bore 22 of tubular member may enter tool annular space 28 by way of uphole perforation 30. The portion of the fluid that enters tool annular space 28 will return to internal bore 22 of tubular member 20 by way of downhole perforation 34. In certain embodiments, the fluid flow being pumped downhole will be free of hydrogen sulfide and therefore such fluid will not react with sacrificial rod 38 as such fluid passes through tool annular space 28 and contacts sacrificial rod 38. As an example, during a drill string test, drilling mud or brine can be pumped downhole through drill stem testing string 16 to prepare the well for testing. Hydrogen sulfide neutralizing tool 18 will not prevent or otherwise interfere with the pumping of fluids downhole through drill stem testing string 16.

Looking at FIG. 3, non-return valve 50 is shown in a closed position and can block the flow of fluids through drill stem testing string 16 in an uphole direction past non-return valve 50. In the example of FIG. 3, the flow of fluids can include reservoir fluids that are being produced to the surface. Non-return valve 50 can move to a closed position automatically without operator intervention when the flow of fluids reverses to an uphole direction, such as when the testing of the formation fluids is commenced. Alternately, an operator can signal for the non-return valve to move to the closed position.

As the flow of fluids travels in the uphole direction, with non-return valve 50 in the closed position the flow of fluids will be blocked from traveling uphole through internal bore 22 of tubular member 20. The flow of fluids will instead be directed into tool annular space 28 by way of downhole perforation 34. The flow of fluids will travel in an uphole direction though tool annular space 28, contacting sacrificial rod 38. After flowing over sacrificial rod 38, the flow of fluids can exit tool annular space 28 and return to internal bore 22 of tubular member 20 by way of uphole perforation 30.

Contact with sacrificial rod 38 will reduce the amount of hydrogen sulfide within the flow of fluids as the hydrogen sulfide reacts with the material of sacrificial rod 38. The reaction of hydrogen sulfide with the material of sacrificial rod 38 results in the consumption of hydrogen sulfide through the production of metal sulfide. Therefore, the amount of hydrogen sulfide in the flow of fluids exiting tool annular space 28 will be less than the amount of hydrogen sulfide in the flow of fluids entering tool annular space 28. The flow of fluid exiting tool annular space 28 can travel in an uphole direction through central bore 24 of drill stem testing string 16 and be produced to the surface.

In an example of operation, in order to neutralize a hydrogen sulfide within subterranean well 10 during drill stem testing operations, hydrogen sulfide neutralizing tool 18 can be made up in-line as part of drill stem testing string 16. Drill stem testing string 16 can be extended into wellbore 12 of subterranean well 10. Drill stem testing operations can be performed.

During drill stem testing operations, fluids can be pumped into drill stem testing string to travel in a downhole direction from the surface through central bore 24 of drill stem testing string 16. A portion of the fluid flow that is pumped downhole through central bore 24 of drill stem testing string 16 from the surface will remain within internal bore 22 of tubular member 20 and will travel through non-return valve 50. Another portion of the fluid flowing through internal bore 22 of tubular member may enter tool annular space 28 by way of uphole perforation 30. The portion of the fluid that enters tool annular space 28 will return to internal bore 22 of tubular member 20 by way of downhole perforation 34. As an example, during a drill string test, drilling mud or brine can be pumped downhole through drill stem testing string 16 to prepare the well for testing. Such fluid can return to the surface through wellbore annular space 17.

During drill stem testing operations, the direction of the flow of fluids is reversed one or more times. As an example, another step of the drill stem testing operations can include producing reservoir fluids to the surface through central bore 24 of drill stem testing string 16. When fluids are flowing in an uphole direction through central bore 24 of drill stem testing string 16, non-return valve 50 will be in a closed position As the flow of fluids travels in the uphole direction, with non-return valve 50 in the closed position, the flow of fluids will be directed into tool annular space 28 by way of downhole perforation 34. The flow of fluids will travel in an uphole direction though tool annular space 28, contacting sacrificial rod 38. After flowing over sacrificial rod 38, the flow of fluids can exit tool annular space 28 and return to internal bore 22 of tubular member 20 by way of uphole perforation 30.

The reaction of hydrogen sulfide with the material of sacrificial rod 38 results in the consumption of hydrogen sulfide through the production of metal sulfide so that the amount of hydrogen sulfide in the flow of fluids is reduced. The flow of fluid exiting tool annular space 28 can travel in an uphole direction through central bore 24 of drill stem testing string 16 and be produced to the surface.

When the hydrogen sulfide reacts with the metal outer surfaces of sacrificial rod 38, the outer surface will crack and portions of the outer surface will peel and fall from sacrificial rod 38 as debris 40. Debris 40 can include the metal sulfides that are formed as a result of the reaction of the hydrogen sulfide with the metal of sacrificial rod 38. Debris 40 can fall in a downhole direction and be trapped within junk basket 42. Debris 40 can be removed from junk basket 42 when drill stem testing string 16 is returned to the surface after the well flow tests and other drill stem tests have been completed.

Therefore embodiments of this disclosure provide systems and methods for utilizing the corrosive nature of hydrogen sulfide to reduce the amount of hydrogen sulfide in a flow of fluids in a subterranean well. One or a combination of multiple sets of hydrogen sulfide neutralizing tools can be used in the downhole string where a higher concentration of hydrogen sulfide is expected. The number of hydrogen sulfide neutralizing tools to be used will depend on the expected concentration of hydrogen sulfide, the neutralization efficiency of the downhole system, and the target concentration of hydrogen sulfide being produced at the surface.

Embodiments of this disclosure reduce the amount of hydrogen sulfide in a wellbore fluid before the wellbore fluid reaches the surface. This will improve the safety of personnel and extend the working life of surface equipment compared to producing fluids that contain higher levels of hydrogen sulfide.

Embodiments described herein, therefore, are well adapted to carry out the objects and attain the ends and advantages mentioned, as well as others inherent therein. While certain embodiments have been described for purposes of disclosure, numerous changes exist in the details of procedures for accomplishing the desired results. These and other similar modifications will readily suggest themselves to those skilled in the art, and are intended to be encompassed within the scope of the present disclosure disclosed herein and the scope of the appended claims.

What is claimed is:

1. A hydrogen sulfide neutralizing tool for neutralizing a hydrogen sulfide within a subterranean well, the hydrogen sulfide neutralizing tool including:

a tubular member with an internal bore;

a tool shell circumscribing the tubular member and defining a tool annular space between an outer diameter surface of the tubular member and an inner diameter surface of the tool shell;

a sacrificial rod located within the tool annular space, the sacrificial rod formed of a material that produces metal sulfide when exposed to the hydrogen sulfide; where the tubular member includes an uphole perforation, the uphole perforation having an opening extending through a sidewall of the tubular member defining a fluid flow path between the tool annular space and the internal bore of the tubular member; and the tubular member includes a downhole perforation, the downhole perforation being located downhole of the uphole perforation and having an opening extending through the sidewall of the tubular member defining a fluid flow path between the tool annular space and the internal bore of the tubular member.

2. The hydrogen sulfide neutralizing tool of claim 1, further including a non-return valve, the non-return valve operable to allow a fluid flow through the non-return valve in a downhole direction and block the fluid flow through the non-return valve in an uphole direction.

3. The hydrogen sulfide neutralizing tool of claim 1, further including a rod structural support, the rod structural support located within the tool annular space and extending between the sacrificial rod to at least one of the tubular member and the tool shell.

4. The hydrogen sulfide neutralizing tool of claim 1, further including a junk basket located within the tool annular space downhole of the sacrificial rod.

5. A system for neutralizing a hydrogen sulfide within a subterranean well with a hydrogen sulfide neutralizing tool, the system including:

a drill stem testing string extending within a wellbore of the subterranean well, the drill stem testing string having a central bore and defining a wellbore annular space between an outer diameter of the drill stem testing string and an inner diameter surface of the wellbore, where the drill stem testing string further includes the hydrogen sulfide neutralizing tool secured in-line, the hydrogen sulfide neutralizing tool having:

a tubular member with an internal bore in fluid communication with the central bore extending through adjacent members of the drill stem testing string;

a tool shell circumscribing the tubular member and defining a tool annular space between an outer diameter surface of the tubular member and an inner diameter surface of the tool shell;

a sacrificial rod located within the tool annular space, the sacrificial rod formed of a material that produces metal sulfide when exposed to the hydrogen sulfide; where the tubular member includes an uphole perforation, the uphole perforation having an opening extending through a sidewall of the tubular member defining a fluid flow path between the tool annular space and the internal bore of the tubular member; and the tubular member includes a downhole perforation, the downhole perforation being located downhole of the uphole perforation and having an opening extending through the sidewall of the tubular member defining a fluid flow path between the tool annular space and the internal bore of the tubular member.

6. The system of claim 5, further including a non-return valve, the non-return valve operable to allow a fluid flow through the drill stem testing string past the non-return valve in a downhole direction, and to block the fluid flow through the drill stem testing string past the non-return valve in an uphole direction.

7. The system of claim 5, further including a plurality of the sacrificial rods, the plurality of the sacrificial rods spaced around a circumference of the tool annular space.

8. The system of claim 7, further including a rod structural support, the rod structural support including a ring shaped member extending between each of the plurality of the sacrificial rods.

9. The system of claim 5, further including a junk basket located within the tool annular space downhole of the sacrificial rod, the junk basket positioned to collect the produced metal sulfide within the drill stem testing string.

10. A method for neutralizing a hydrogen sulfide within a subterranean well with a hydrogen sulfide neutralizing tool, the method including:

providing the hydrogen sulfide neutralizing tool having:

a tubular member with an internal bore;

a tool shell circumscribing the tubular member and defining a tool annular space between an outer diameter surface of the tubular member and an inner diameter surface of the tool shell;

a sacrificial rod located within the tool annular space, the sacrificial rod formed of a material that produces metal sulfide when exposed to the hydrogen sulfide; where the tubular member includes an uphole perforation, the uphole perforation having an opening extending through a sidewall of the tubular member defining a fluid flow path between the tool annular space and the internal bore of the tubular member; and the tubular member includes a downhole perforation, the downhole perforation being located downhole of the uphole perforation and having an opening extending through the sidewall of the tubular member defining a fluid flow path between the tool annular space and the internal bore of the tubular member;

forming a drill stem testing string having the hydrogen sulfide neutralizing tool secured in-line;

extending the drill stem testing string within a wellbore of the subterranean well, the drill stem testing string having a central bore and defining a wellbore annular space between an outer diameter of the drill stem testing string and an inner diameter surface of the wellbore; and directing a flow of fluids through the hydrogen sulfide neutralizing tool to contact the sacrificial rod, consuming the hydrogen sulfide from the flow of fluids by producing the metal sulfide from the sacrificial rod.

11. The method of claim 10, where the hydrogen sulfide neutralizing tool further includes a non-return valve, the non-return valve allowing a fluid flow through the non-return valve in a downhole direction and blocking the fluid flow through the non-return valve in an uphole direction.

12. The method of claim 10, further including directing a flow of fluid traveling in an uphole direction:

from the internal bore of the tubular member, through the downhole perforation, and into the tool annular space;

past the sacrificial rod; and from the tool annular space, through the uphole perforation, and into the internal bore of the tubular member.

13. The method of claim 10, further including supporting the sacrificial rod with a rod structural support, the rod structural support located within the tool annular space and extending between the sacrificial rod to at least one of the tubular member and the tool shell.

14. The method of claim 10, where the hydrogen sulfide neutralizing tool further includes a plurality of the sacrificial rods, the plurality of the sacrificial rods spaced around a circumference of the tool annular space.

15. The method of claim 14, further including supporting the sacrificial rod with a rod structural support, the rod structural support including a ring shaped member extending between each of the plurality of the sacrificial rods.

16. The method of claim 10, further including collecting the metal sulfide in a junk basket located within the tool annular space downhole of the sacrificial rod.

* * * * *